US005113530A

United States Patent [19]

Smith

[11] Patent Number: 5,113,530

[45] Date of Patent: May 19, 1992

[54] FIELDER'S GLOVE WITH INFLATABLE CHAMBERS

[76] Inventor: Flynn K. Smith, 307 Brockenbraugh Ct., Metairie, La. 70005

[21] Appl. No.: 702,834

[22] Filed: May 20, 1991

[51] Int. Cl.[5] ..... A41D 13/10; A41D 19/00

[52] U.S. Cl. ..... 2/19; 2/161 A

[58] Field of Search ..... 2/19, 20, 161 A, 413; 36/71, 89, 93, 88, 92, 114, 115, 119, 91

[56] References Cited

U.S. PATENT DOCUMENTS

| | | | |
|---|---|---|---|
| 450,717 | 4/1891 | Reach | 2/19 |
| 812,921 | 2/1906 | Decker | 2/19 |
| 1,362,280 | 12/1920 | Young | 2/19 |
| 1,465,223 | 8/1923 | Kobbe | 2/19 |
| 1,602,027 | 10/1926 | Kennedy | 2/19 |
| 1,974,616 | 9/1934 | Kirkham | 2/19 |
| 4,453,272 | 6/1984 | Miyake et al. | 2/19 |
| 4,702,022 | 10/1987 | Porcher | 36/119 |
| 4,776,110 | 10/1988 | Shiang | 36/3 B |
| 4,912,861 | 4/1990 | Huang | 36/71 |
| 4,999,932 | 3/1991 | Grim | 36/88 |
| 5,003,631 | 4/1991 | Richardson | 2/413 |

*Primary Examiner*—Werner H. Schroeder
*Assistant Examiner*—Michael A. Neas
*Attorney, Agent, or Firm*—Pravel, Gambrell, Hewitt, Kimball & Krieger

[57] ABSTRACT

A fielders glove, which comprises a hand receiving portion, a plurality of finger portions, a thumb portion, and a web portion extending between the finger portions and the thumb portion, at least one inflatable chamber in the hand receiving portion of the glove, a pump for manually forcing air into the inflation chamber, so that the inflated chamber softens the impact of a baseball making contact with the palm portion of the glove, and a valve to release the air from the chamber upon ball contact with the palm portion, or to manually release air from the air chamber, when desired.

14 Claims, 5 Drawing Sheets

FIELDER'S GLOVE WITH INFLATABLE CHAMBERS

BACKGROUND OF THE INVENTION

1. Field Of The Invention

The present invention relates to baseball gloves. More particularly, the present invention relates to a baseball glove having one or a plurality of inflatable chambers in the palm portion of the glove, which may be manually inflated by the wearer of the glove, and wherein the air in the chambers can be either manually or, through force, released from the chambers.

2. General Background

In the sport of baseball, the fielders glove is an essential item which all members of the team, on defense, wear, in order to retrieve a ball that has been thrown or hit to them during the course of play. Over the years that the sport has been in existence, some changes have been made in the construction of baseball gloves, such as the shape of the web portion of the glove, in order to form a larger area to catch the ball, or to give the overall glove larger proportions.

However, few modifications have addressed the portion of the baseball glove which covers the palm of the players hand. This area of the glove should be of concern since a great number of the balls caught by a player are caught in this section of the glove, i.e., the portion between the lower glove edge and the bottom of the fingers. Oftentimes this results in a painful stoppage of the ball, since the palm portion possesses very little, if any, padding, and usually only a double layer of material, such as leather on the exterior and fabric next to the players palm, between the impact of the ball and the players bare hand. This fact is even more pronounced when children are involved. Due to the fact that children are less agreeable to the pain of handling a ball in the palm area of the glove, there is a need to reduce or completely eliminate this eventuality.

Other objects of the invention will be obvious to those skilled in the art from the following description of the invention.

SUMMARY OF THE PRESENT INVENTION

The apparatus of the present invention solves the problems in the art in a simple and straightforward manner. What is provided is a fielders glove, which comprises a hand receiving portion, a plurality of finger portions, a thumb portion, and a web portion extending between the finger portions and the thumb portion, at least one inflatable chamber in the hand receiving portion of the glove, means for manually forcing air into the inflation chamber, so that the inflated chamber defines a means to soften the impact of a baseball making contact with the palm portion of the glove, means to release the air from the chamber upon ball contact with the palm portion, and means to manually release air from the air chamber, when desired.

It is therefore a principal object of the present invention to provide a fielders glove which enables the wearer to be protected against the impact of a baseball making contact into the palm portion of the glove;

It is a further object of the present invention to provide an improved fielders glove which includes a palm portion that can be manually inflated or deflated by the wearer;

It is still a further object of the present invention to provide a fielders glove wherein the palm portion can be manually inflated, but will deflate automatically upon impact by a fast-traveling baseball;

It is still a further object of the present invention to provide a baseball glove that can be worn by a child and reduce the fear that a child might have of a fast-moving baseball from painfully making contact with the palm portion of the glove worn by the child;

It is still a further object of the present invention to provide an improved baseball glove which children and adults will find both useful and attractive to use in order to improve their play in hard ball such as baseball;

It is still a further object of the present invention to provide a baseball glove wherein the palm portion can be manually inflated, but upon being struck by a baseball, is automatically deflated so as to prevent the ball from rebounding out of the glove.

BRIEF DESCRIPTION OF THE DRAWINGS

For a further understanding of the nature and objects of the present invention, reference should be had to the following detailed description taken in conjunction with the accompanying drawings, in which like parts are given like reference numerals, and wherein.

DETAILED DESCRIPTION OF THE PREFERRED EMBODIMENT

Figure 1:
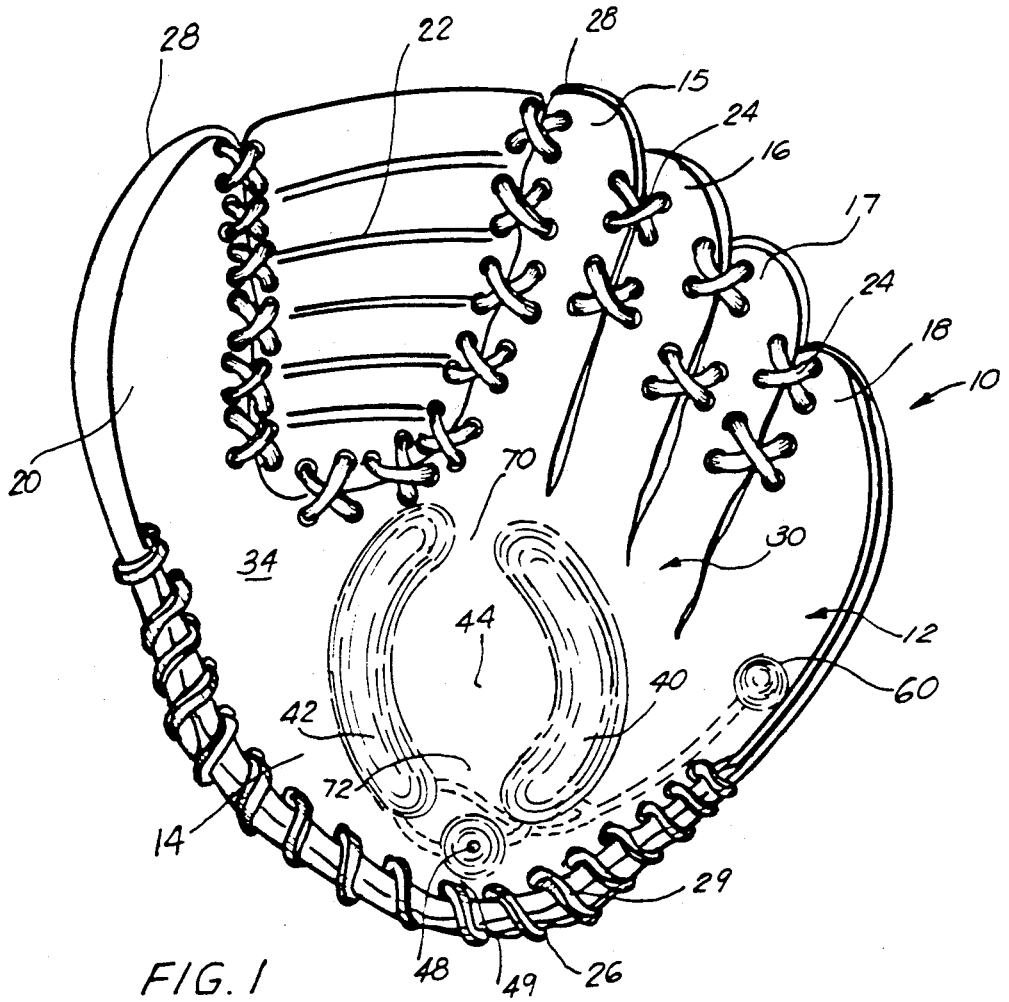
FIG. 1 illustrates an overall view of the preferred embodiment of the apparatus of the present invention.

FIGS. 1 through 9B illustrate the preferred embodiment of the present invention by the numeral 10. Improved fielders glove 10 comprises an overall glove member 12, which includes a lower hand, or palm portion 14, a plurality of finger portions 15, 16, 17, and 18, and a thumb portion 20, connectedly engaged to the lower hand portion 14, for defining the glove 10 into which the wearer would position his hand. There is further included a web portion 22, which is an elongated section of fabric, more preferably leather, which extends between the gap formed between the thumb portion 20 and the index finger portion 15. As is illustrated, each of the finger portions 15 through 18 are secured together, typically, by a series of leather cross stitching 24, so that the glove from the lower most edge 26 of the palm portion 14 to the tips 28 of the fingers and thumb forms a means to either stop, or preferably catch a fast-moving baseball during play.

As in all gloves, and like the present glove 12, the glove, along its backside would provide an upper layer of leather stitched along edge 26 with stitching 29, with the upper layer forming the upper wall of the glove 12, so that the wearer could slide his hand in the glove 12 when ready to play. Typically, the web portion 22 would serve as the principal area of the glove for stopping or catching a baseball, since there is no contact to the players hand by the ball and the thumb and forefinger is able to surround the ball as it strikes the web 22.

However, many balls are caught by the wearer of the glove 12, during the course of a game in the palm portion 14, which can be defined as that area of the glove between the lower ends 30 of the fingers and thumb 20 and the lower edge 26 of the palm portion 14. To catch a ball in this area of the glove is often undesirable since in most gloves, the palm portion includes no padding whatsoever, other than along the lower edge 26, as do the finger and thumb portions, but is simply comprised of an outer layer of fabric, preferably leather 34, and an inner layer of leather of other lightweight material next to the players hand. Therefore to be struck with a fast-moving baseball in this area of the glove is painful, and certainly uncomfortable, particularly to children who are not as skilled and are just learning the game.

In the improved glove 12 of the present invention there is included in combination, a means to provide a protective layer between the hand of the wearer and the impact of the baseball. As seen in FIG. 1 in phantom view, and in FIG. 2 in isolated view, this means comprises a first air chamber 40 and at least a second air chamber 42, positioned between the outer layer of leather 34 and the inner fabric layer, against which the player's hand is positioned. It is foreseen that chambers 40, 42 would be inserted between the leather layer 34 and the inner fabric layer, and would be separate chambers of an inflatable, rubber-type material to contain a fluid, such as air, under pressure, therein. The pair of chambers 40, 42 would be able to receive a quantity of air manually pumped into the chambers by the wearer so that the air in the chambers defines the protective layer.

Figure 2:
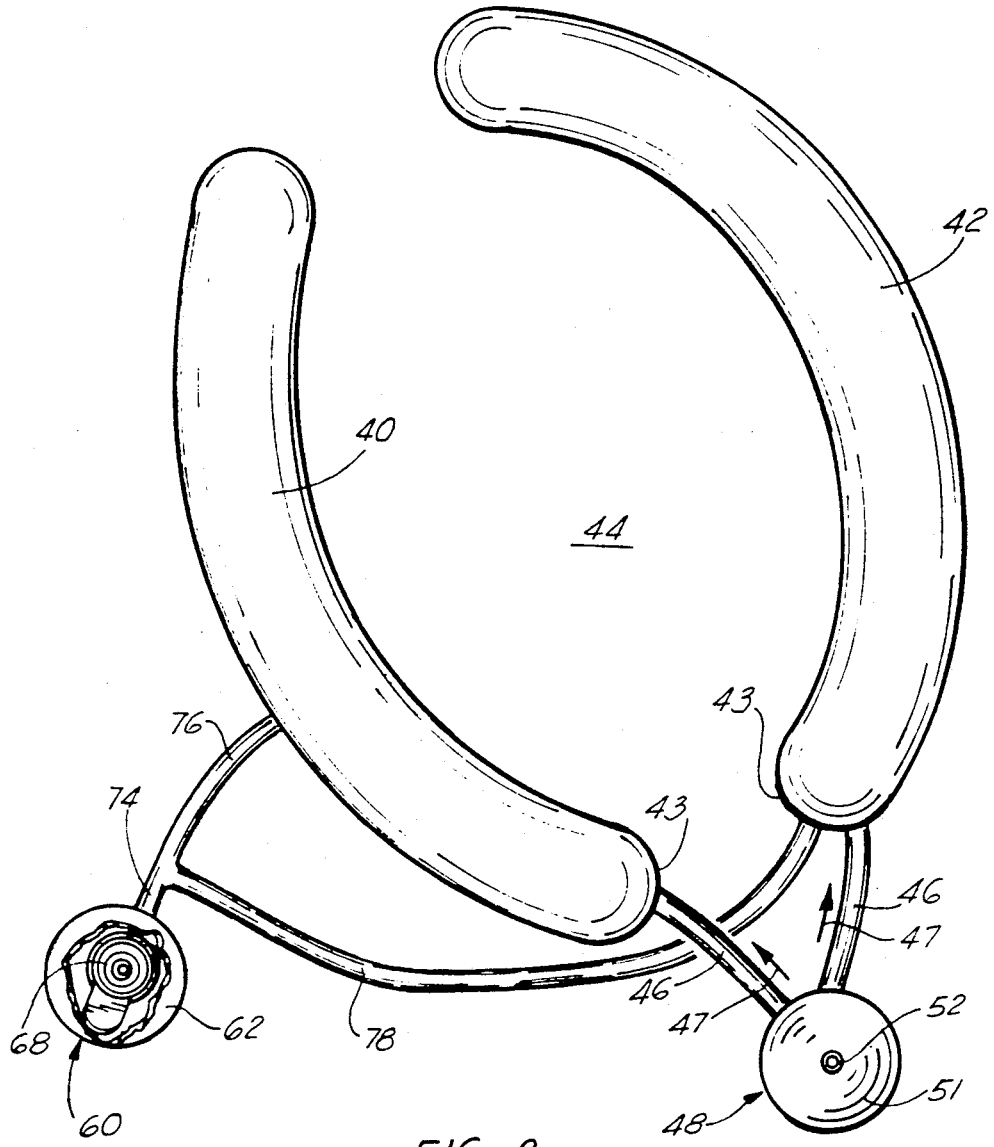
FIG. 2 illustrates an isolated view of the inflation chambers, including the means to inflate and deflate the chambers, in the preferred embodiment of the present invention.

As illustrated, in the preferred embodiment in FIGS. 1 and 2, each chamber 40, 42 would be positioned so as to be somewhat crescent shaped, with the chambers 40, 42 positioned along the palm portion 14. The chambers 40, 42 further define a target area 44 therebetween where the baseball would strike, but rather than make initial contact with the leather in the target area 44, would contact the area of the leather above the inflated chambers, which would absorb the initial impact of the fast-moving ball.

As illustrated, in addition to the air chambers 40, 42, the inflation system would provide a means to manually pump air into each of the chambers, and a means to manually or upon impact against the wall of the chambers, release air from the chambers. Reference is made to FIG. 2 where this system is illustrated in detail. As illustrated, there would be first positioned preferably on the base of the palm portion, intermediate each of the lower ends 43 of chambers 40, 42, a pumping means 48, interconnecting each chamber 40, 42 with an internal air transport line 46 leading from the lower ends 43 thereof, each air transport line 46 terminating in the pumping means 48 at the center base 49 of the glove along lower edge 26. Pumping means 48, as will be discussed, defines a means to manually pump air into the chambers 40, 42 by the wearer of the glove.

Figure 4:
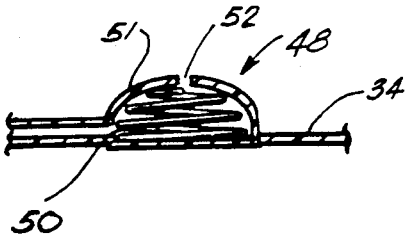
FIG. 4 illustrates a side cutaway view of the pumping element to inflate the chambers in the preferred embodiment of the present invention.
Figure 4A:
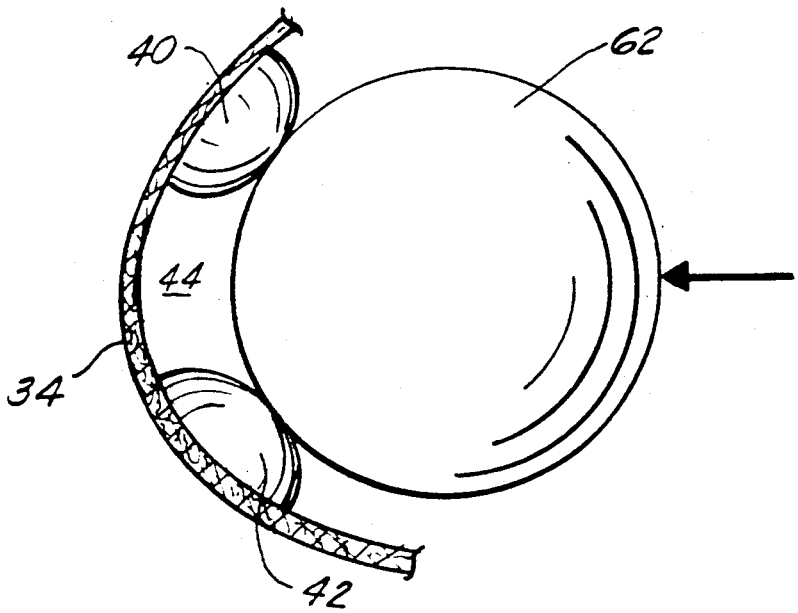
Figure 4B:
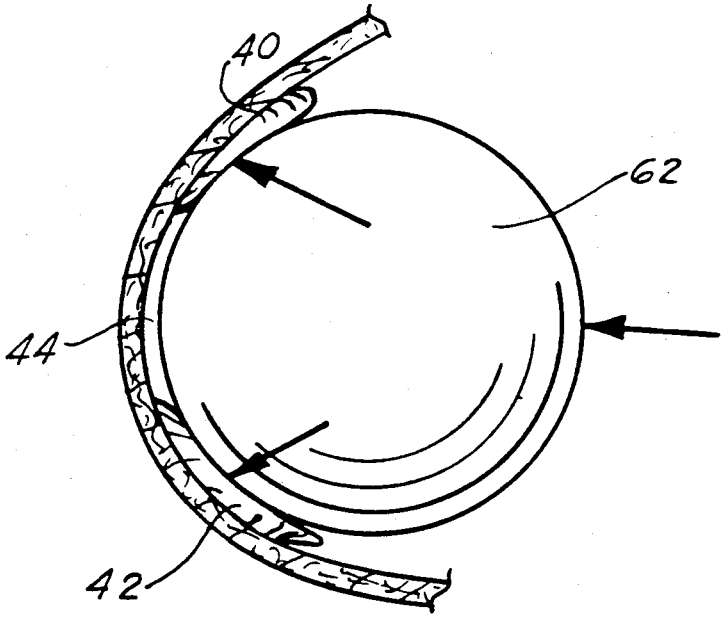

Pumping means 48, as illustrated in simplified version in FIG. 4, would comprise a raised circular flexible cover portion 51, extending out from the leather layer 34, and having a spring member 50 therein, and an air entry and port 52 in the center of the cover portion 51. The cover portion 51 would serve as a means to collect air therein through the air entry port 52 when in the raised position, with the air from the outside entering through port 52. Pumping means 48 would be in communication with the pair of air transport lines 46, each air line 46 extending from the pumping means 48 to each of the chamber 40, 42, for carrying air from the pumping means 48 to each chamber 40, 42. In the preferred embodiment, cover portion 51 would be of a flexible, resilient material, so that the cover could be manually depressed by the wearer of the glove 12, by placing ones finger or thumb on the cover portion 51, and in doing so, sealing the air entry port 52. Therefore, when depressed, the air (arrows 47) would be forced into air lines 46 and then into each chamber 40, 42, as the pumping action continued, thus inflating chambers 40, 42 to the desired level of inflation.

Figure 3A:
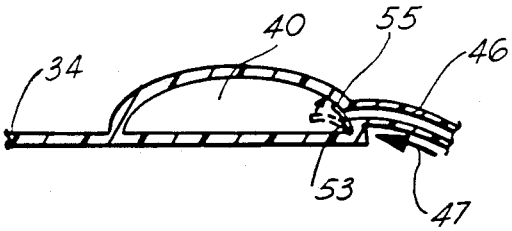
FIGS. 3A and 3B illustrate cross-section views of the two inflation chambers illustrating the one-way valves incorporated therein.
Figure 3B:
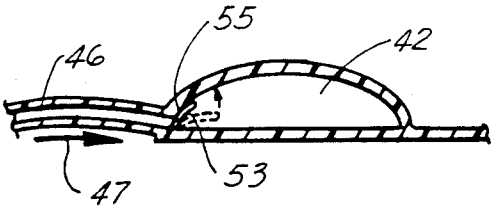

As illustrated in FIGS. 3A and 3B, each air transport line 46 would be provided with a one-way valving member 53 at the entrance to each chamber 40, 42, which would further comprise a one-way flapper valve 55, which, as seen in the Figure, would move to the open position (phantom view) as air enters from lines 46, in the direction of arrow 47, but, when the pumping action stops would return to the up position, so that the air, once pumped from pumping means 48, could not return back into cover portion 51, but would be maintained in chambers 40, 42 until one desired to manually release the air from chambers 40, 42, or until the impact of the ball releases the air therefrom.

Figure 5:
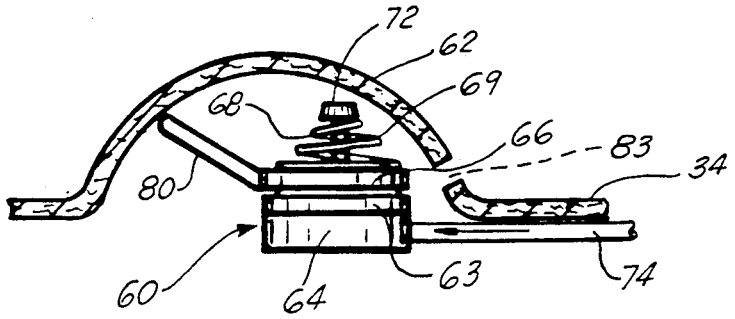
FIG. 5 illustrates a side cutaway view of the valve member for manually deflating the chambers in the preferred embodiment of the present invention.
Figure 6:
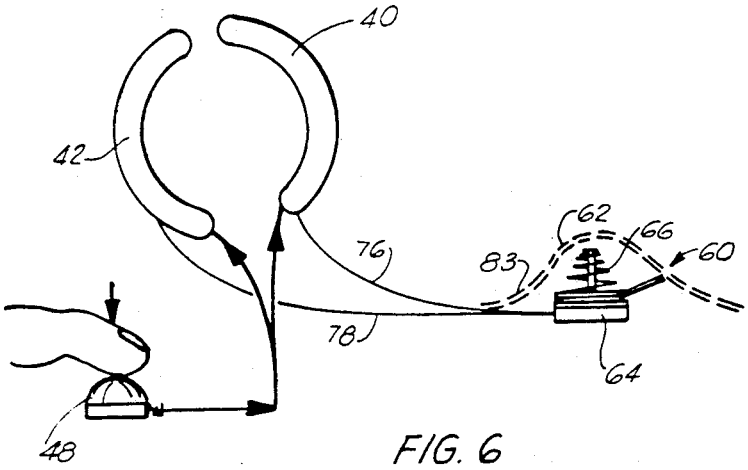
FIG. 6 illustrates an overall view of the valving system of the present invention during inflation of the chambers.
Figure 7:
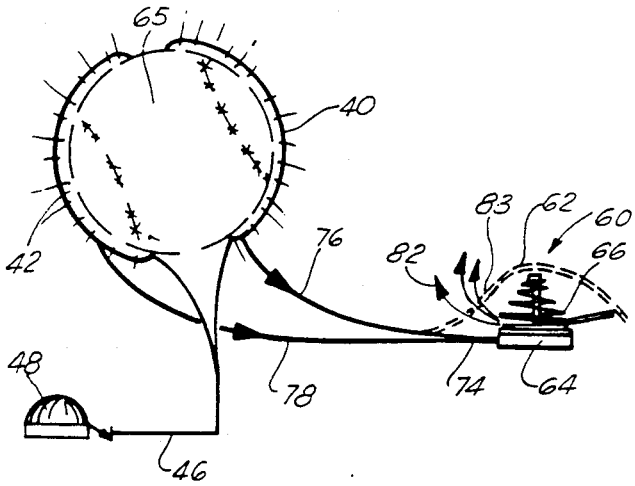
FIG. 7 illustrates a frontal view of a baseball impacting against the inflated chambers during use.

Turning now to the means for releasing the air from chambers 40, 42 after the chambers have been inflated via pumping means 48, reference is made to FIGS. 5 through 8. As illustrated in overall side cutaway view in FIG. 5, the means for releasing the air comprises a valving member 60. Valving member 60 comprises, again, a raised cover portion 62, which could be sewn into the cover leather 34, or be a separate flexible, cap integral with the outer layer of the glove. As seen in FIG. 1, in overall view, preferably, valving member 60 would be positioned off to the side of the palm portion 14, adjacent the lower edge of the finger member 18, although it could be placed elsewhere. As seen in FIG. 5, valving member 60 further comprises a spring-loaded valving element 63, which includes a base portion 64, and a moveable upper portion 66. Upper portion 66 would be held in normal sealing engagement against the upper face of base 64 via the spring member 68 which is mounted around a stem 69 which extends through the coils of spring 68, and is mounted to the base 64. Stem member 69 includes a cap portion 72 to maintain spring 68 in sufficient compressed relationship to seal air from exiting between the base 64 and the upper portion 66, until wanted. As further seen, there is an air line 74 extending from the side wall of base 64, and as seen in FIGS. 6 and 7, the air line 74 leads to a pair of air lines 76, 78 which enter into each of the chambers 40, 42, and is the line for transporting air from the chambers during deflation.

Figure 8:
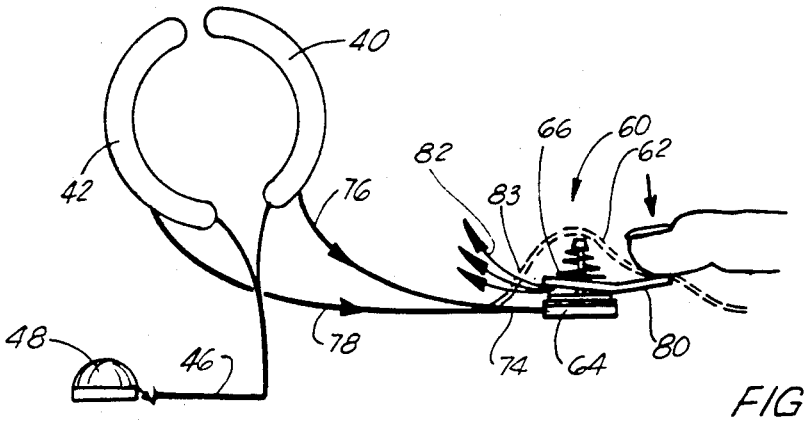
FIG. 8 illustrates a view of the apparatus of the present invention during manual deflation of the chambers.

During operation, valving means 60 may be operated either manually or through the air being forced from the chambers. This operation is seen clearly in FIGS. 6 through 8. As illustrated, once air has been pumped into chambers 40, 42 via the pumping means 48, one may want to manually release the air. Therefore, valving element 63 as seen in the figures, includes an arm 80 connected to the upper portion 66 of the valving member 63. As seen in FIG. 8, upon manual depression of the cover 62 imparts a downward force on arm 80. When this occurs, the upper portion 66 is tilted out of sealing engagement with the base portion 64, against the bias of spring 68, and the air then can be released from line 74, (see arrows 82), through a port 83 in the cap member 62 of the valving means 60. Of course, when the handle is released, the spring forces the upper portion 66 to return to sealing engagement with base 64, and the air maintained within the system.

The second means for releasing air involves the forcing of air from the system by the impact of a fast-moving baseball 65 into the palm portion 14 of the glove, and impacting the chambers 40, 42. This is illustrated in FIG. 7. Upon this occurring air would then be forced against the upper portion 66 of valving element 63. The force of the air would force the upper portion 66 to move upward against the bias of spring 68, and in doing so, overcome the bias of spring 68, thus having the upper portion 66 to move to non-sealing relationship with base 64. At that moment, air would travel out of valving member 63, and be released through the port 83 in the cap 62 of the valving means 60.

Figure 9A:
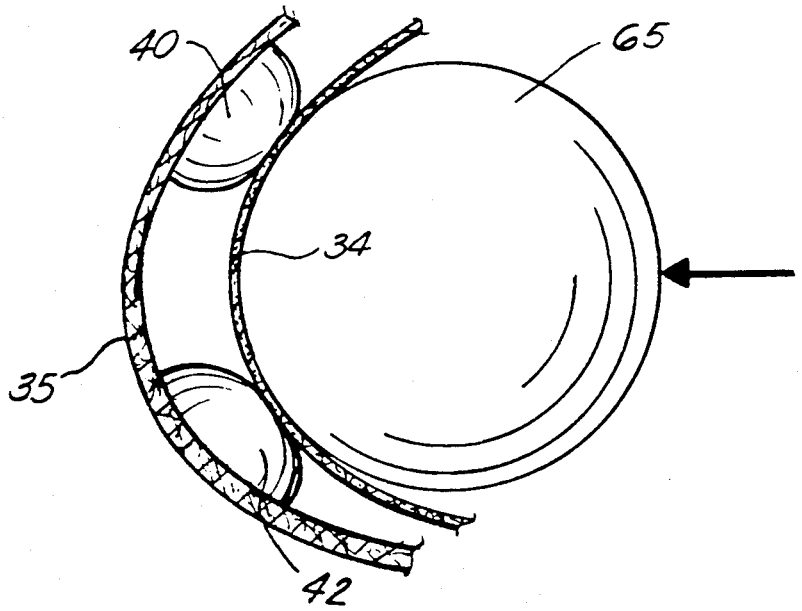
FIGS. 9A and 9B illustrate representative views of the action of the inflation chambers before and after impact of a fast-moving baseball, respectively.
Figure 9B:
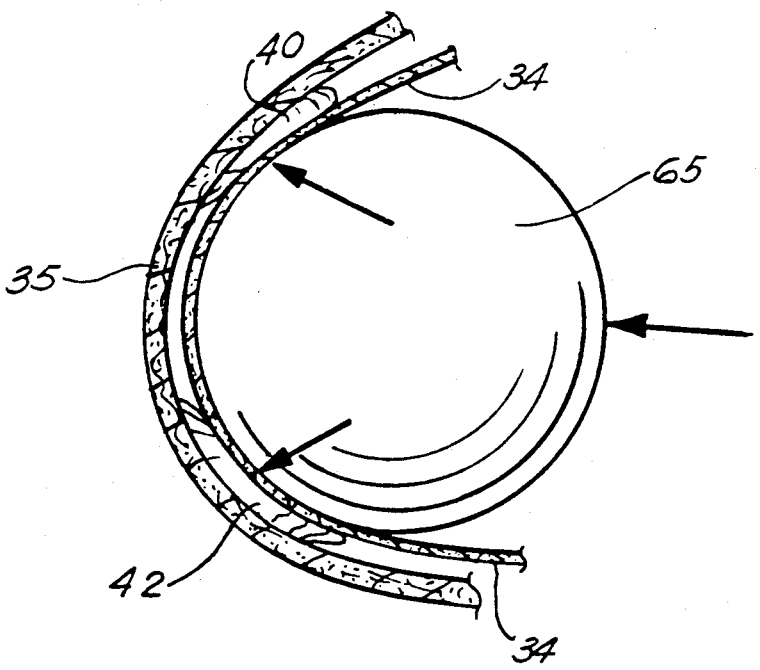

FIGS. 9A and 9B are included to illustrate that, as was stated earlier, the inflated chambers 40, 42, as illustrated, serve as a means to define a target area 44 therebetween, yet also serve as a means to prevent the ball 62 from making contact with the bare outer layer of leather 34 discussed earlier. As illustrated, when ball 65 makes contact when the chambers 40, 42 are inflated, it is momentarily prevented from striking area 44 upon initial impact. However, in order to prevent chambers 40, 42 from rebounding the ball outwardly of the palm area, the valving operation as previously described comes into play. Apparatus in combination includes a means for allowing the chambers 40, 42 to instantaneously deflate from the impact of the ball. Therefore, the dual purpose of allowing the ball to be cushioned in its impact against the wearer's hand and the deflation of the chambers 40, 42 upon impact of ball 65 is achieved with the present invention.

It should be made clear that the arrangement of, and the number of chambers can be modified. The pair of chambers 40, 42 as seen in the drawings were chosen, since, as illustrated, the gap 70, 72 between the ends of the chambers 40, 42 enable the glove to be folded over in the normal fashion, since the fold between the thumb and fingers would occur normally across gaps 70, 72 and thus not restrict normal operation of the glove even when the chambers 40, 42 were inflated.

It is foreseen that a player, such as a child, in the field could choose whether to inflate or not inflate the chambers, depending on the circumstances. Once inflated, the child could have the option of deflating manually by depressing cover 62, or waiting until impact of the ball to automatically deflate chambers 40, 42. The apparatus, therefore, other than the usefulness of providing a means to prevent or at least reduce the painful impact of a fast-moving baseball in the palm area of a fielder's glove, also would be entertaining for children, much as the "pump" shoe has been for sneakers.

For purposes of construction, it should be made clear, as illustrated in FIG. 1, that the overall system, as described would be positioned beneath the upper layer of leather 34, including the chambers 40, 42 and the various air lines utilized in the system. The only portions of the system on the exterior of the glove face would be the pump member, for pumping air into the chambers, and the valving member, for manually, or forcibly removing the air from the chambers. It is also noted that the number and position of the chambers could vary and are not restricted to the two chambers as illustrated. The valving member may operate in a slightly different fashion to accomplish the same end, and the glove may include perhaps several valving members for accommodating a greater quantity of air to be released from the chambers.

Therefore, with this invention, a wearer of the glove is able to manually pump air into the chambers 40, 42 with the air being maintained in the chambers until impact of a fast-moving baseball forces the air out, or until one manually wishes to allow air to be released from the chambers.

Parts list:
glove 10
glove member 12
palm portion 14
finger portions 15, 16, 17, 18
thumb portion 20
web portion 22
cross stitching 24
lower most edge 26
tips 28
stitching 29
lower ends of fingers 30
outer leather layer 34
first air chamber 40
second air chamber 42
target area 44
lower ends of chambers 43
air line 46
pumping means 48
center base 49
flexible cover portion 51
air entry port 52
one-way valving member 53
flapper valve 55
valving member 60
raised cover portion 62
valving element 63
base portion 64
upper portion 66
spring member 68
stem 69
arrows 82
port 83
ball 65
gaps 70, 72
stem cap 73
arm 80
air line 74
air line 76
air line 78

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A baseball glove, comprising:

a) a hand receiving portion, further comprising a palm portion, a plurality of finger portions, and a thumb portion;

b) a web portion extending between the thumb portion and the finger portions;

c) chamber means in the palm portion for receiving a quantity of fluid therein, to define an inflated area of the palm portion;

d) means positioned on the glove for manually pumping the fluid into the chamber means in the palm portion; and e) means activated by the impact of an airborn ball striking at least a portion of the chamber means for allowing fluid contained within the chamber means to be released therefrom when the airborn ball makes contact with at least a portion of the palm portion of the glove positioned above the chamber means.

2. The baseball glove in claim 1, wherein the fluid comprises air.

3. The baseball glove in claim 1, further comprising valving means for manually releasing fluid from the chamber means.

4. The baseball glove in claim 1, wherein the chamber means further comprises at least two chambers positioned along a pair of semi-circular radii, for defining a central target area on the palm portion of the glove.

5. The baseball glove in claim 1, wherein the chamber means is positioned between an outer layer or leather and an inner layer of fabric along the palm portion.

6. The baseball glove in claim 1, wherein the means for allowing fluid contained in the chamber means to be released upon contact by an airborn ball further comprises in part a compressible cap positioned on the outer base of the glove.

7. A baseball glove, comprising:

a. a palm portion, a plurality of finger portions, a thumb portion, together defining a means for catching a baseball in flight;

b. at least one inflatable chamber, positioned at the palm portion for receiving a quantity of air therein;

c. means positioned on the glove for manually pumping the quantity of air into the at least one inflatable chamber;

d. valving means for maintaining the quantity of air pumped into the at least one inflatable chamber; and e. means for releasing a portion of the air from the at least one inflatable chamber, said means activated upon: 1) the impact of a fast-moving baseball against the at least one inflatable chamber beneath the palm portion of the glove, or 2) manual activation of the releasing means by the wearer of the glove.

8. The baseball glove in claim 7, wherein there is provided more than one inflatable chamber in the palm portion.

9. The baseball glove in claim 7, where the at least one inflatable chamber is positioned between an outer leather covering of the glove and an interior fabric layer.

10. The baseball glove in claim 7, wherein the at least one inflatable chamber forms a target area in the palm portion of the glove.

11. The baseball glove in claim 7, wherein the valving means further comprises a compressible cap positioned on the exterior of the base of the glove so that the wearer of the glove may operate the valving means manually.

12. An improved baseball glove of the type having a leather covering, a palm portion, a plurality of finger portions, a thumb portion, and further comprising a web portion interconnecting the thumb portions with the finger portions, and together defining an area for catching a fast-moving ball therein, the improvement comprising:

a) at least one inflatable chamber positioned in the palm portion of the glove, beneath the leather covering for receiving a quantity of air therein;

b) a pump member positioned on the exterior of the glove for defining a means to manually pump air into the at least one inflatable chamber by the wearer of the glove;

c) valving means for releasing the air from the at least one inflatable chamber when the valving means is 1) activated manually by the wearer of the glove, or 2) activated by the ball striking the palm portion of the glove above the at least one inflatable chamber; and d) a fluid line extending from the at least one inflatable chamber for carrying the air from the chamber upon activation of the valving means.

13. The improved glove in claim 12, wherein the at least one inflatable chamber may comprise one or more inflatable chambers for receiving air therein.

14. The improved glove in claim 12, wherein the at least one inflatable chamber defines a target area one inflated, so that a fast-moving baseball makes contact with the at least one inflated chamber prior to making contact with the leather surrounding the chambers.

* * * * *

UNITED STATES PATENT AND TRADEMARK OFFICE

CERTIFICATE OF CORRECTION

PATENT NO. : 5,113,530

DATED : May 19, 1992

INVENTOR(S) : FLYNN K. SMITH

It is certified that error appears in the above-identified patent and that said Letters Patent is hereby corrected as shown below:

Title page, after [22] filed: and col. 1, line 4, insert;

--This is a Continuation-in-Part of U.S. Patent Application, Serial No. 573,330, [entitled "Fielder's Glove With Inflatable Chambers",] filed on August 27, 1990, [by the same inventor], now abandoned.--

Signed and Sealed this

Twenty-fourth Day of August, 1993

*Attest:*

*Attesting Officer*

BRUCE LEHMAN

*Commissioner of Patents and Trademarks*